US005502928A

United States Patent [19]

Terry

[11] Patent Number: 5,502,928

[45] Date of Patent: Apr. 2, 1996

[54] TENSION BRACED DOME STRUCTURE

[75] Inventor: Wesley R. Terry, North Tonawanda, N.Y.

[73] Assignee: Birdair, Inc., Amherst, N.Y.

[21] Appl. No.: 281,224

[22] Filed: Jul. 27, 1994

Related U.S. Application Data

[63] Continuation-in-part of Ser. No. 132,566, Oct. 6, 1993, abandoned.

[51] Int. Cl.[6] ..... E04B 1/32

[52] U.S. Cl. ..... 52/80.1; 52/63; 52/83

[58] Field of Search ..... 52/80.1, 80.2, 52/81.1, 63, 83, 22

[56] References Cited

U.S. PATENT DOCUMENTS

| | | | |
|---|---|---|---|
| 3,410,039 | 11/1968 | Brezina | 52/80.1 |
| 3,886,961 | 6/1975 | Geiger | 52/80.1 X |
| 5,058,334 | 10/1991 | Yamada | 52/80.1 |
| 5,146,719 | 9/1992 | Saito | 52/80.1 |
| 5,315,801 | 5/1994 | Anderson | 52/63 |

*Primary Examiner*—Carl D. Friedman
*Assistant Examiner*—Beth Aubrey
*Attorney, Agent, or Firm*—Kellie M. Muffoletto; Saperston & Day

[57] ABSTRACT

The present invention is a tension braced dome structure comprised of a top ridge having at least one upper ridge radial member and at least one circumferential member which is concentric with an edge member; wherein the upper ridge radial member and the circumferential member are capable of carrying compressive and tensile loading; and further comprising a tensegrity grid having at least one diagonal member, and at least one lower compression member, and at least one lower cicumferential member; wherein said diagonal member extends between the upper ridge radial member and the compression member; and still further having a means for resolving internal stresses as an integral part of the top ridge; and a means for adjusting tension in the diagonal member.

13 Claims, 7 Drawing Sheets

TENSION BRACED DOME STRUCTURE

This application is a continuation-in-part of U.S. Ser. No. 08/132,566, filed Oct. 6, 1993 and entitled Cabled-Braced Dome Structure, abandoned.

FIELD OF THE INVENTION

This invention relates to a roof structure and more specifically to a dome structure which combines the structural advantages of a single layer steel-braced dome and a cable truss dome to result in a structure capable of spanning large areas economically.

BACKGROUND OF THE INVENTION

Arenas, stadiums, entertainment and sports facilities are ideally suited for dome coverings. Domed roof structures provide enhanced lighting, optimum seating visibility and satisfy a desire for a feeling of openness.

The early domed roof structures were steel-braced domes of varying designs which were capable of reaching a clear span of almost 700 feet. Steel-braced dome structures have the capacity to carry loads in both the radial and circumferential directions. The most noteworthy of the braced dome designs is the Superdome over the sports stadium in New Orleans. The advantages of the braced dome lie in its ability to resist loads with a force system acting in the surface of the shell in the radial and circumferential directions. The disadvantages of the steel-braced dome design lies in the fact that it is heavy, costly and difficult to construct. In addition single layer braced domes of large span, especially under unsymmetrical loads, may exhibit instability behavior in a snap - through buckling mode.

To achieve lower construction costs and to improve performance of dome structures, the cable-truss dome was designed. Various cable-truss designs have been disclosed in U.S. Pat. No. 4,736,553 issued to Geiger; U.S. Pat. No. 4,757,650 issued to Berger; and U.S. Pat. No. 5,259,158 issued to Levy. The cable-truss design is lighter, easier to construct and less expensive to build than the traditional steel-brace dome. Other advantages include the use of continuous tension members, such as cables, to form low shallow arches that support a lightweight membrane cladding which gives bracing to the truss.

However, the cable-truss design is limited by its inability to carry loads in the circumferential direction. In addition, the design of the cable-truss dome requires an outer compression ring. The stadium, therefore, exists separate from the compression ting which functions as an anchor for the cable net system. The need for a compression ring limits the cable-truss design's ability to cover structures having straight walls. Since the majority of members are tension only members, such as cables, a large pre-stress to the cable truss must be introduced to prevent the cables from going slack under applied loads and to also increase the overall stiffness of the cable-truss system. Under a down load the cable-truss dome will lose load in the top and increase load in the bottom, in order to prevent this load shifting the cables must be prestressed to a very high tension. The stresses which this places on other members of the system are balanced by the compression ting. The need for a compression ting results in the inability of the cable-tress dome to be readily adaptable to stadiums designed to have fiat walls. Moreover, the compression ting adds significant expense to the cost of constructing the cable-truss dome.

Part of the cable-truss design's appeal lies in the fact that it can be constructed by way of a pre-assembly on the ground instead of the piecemeal erection required with the braced-dome design. However, the use of continuous tension only members, such as cables, requires sophisticated computer analysis of each construction step in order to ensure overall building stability and intermittent cable forces, due to the large displacements the structure undergoes during the construction phase. Moreover, the preferred means for erecting the cable-truss dome is by building it in an inverted position as taught by Richard Buckminster Fuller in U.S. Pat. No. 3,139,957, a rather difficult and time consuming method of erecting the dome.

As a result, there continues to be a need in the industry for an economical roof structure which is capable of spanning large areas and flat wall designs and which provides increased stability by being able to carry compressive and tensile loads in both the radial and circumferential directions. In addition, there is a need for a roof structure which can be fined-tuned by adjusting the tension in the tension members to make it equally as efficient to carry compressive loads under a downward live load as it is to carry tension under an upward wind load. Likewise, there is a need for a roof structure which is easy to construct and allows construction to progress sequentially from the outer perimeter to the center without the need for shoring towers.

SUMMARY OF THE INVENTION

The present invention is a dome structure having a top ridge in compression and a lower ridge under tension. In the preferred embodiment the dome is comprised of a top ridge having at least one upper ridge radial member and at least one circumferential member which is concentric with an edge member; wherein the upper ridge radial member and the circumferential member are capable of carrying compressive and tensile loading; and further comprising a tensegrity grid which is an arrangement of tension members, having at least one diagonal member, and at least one compression member and at least one lower circumferential member; wherein said diagonal member extends between the upper ridge radial member and the compression member; and still further having a means for resolving internal stresses as an integral part of the top ridge; and a means for adjusting tension in the diagonal member.

Accordingly, an overall object of the invention is to provide a roof structure which exhibits the structural advantages of a steel-braced dome and a cable truss dome.

A more particular object of this invention is to provide a dome structure wherein the top ridge of the dome structure consists of framing which exhibits the features of a braced dome thereby allowing the top ridge system to carry compressive or tensile loads in the radial and circumferential directions.

Still another object of this invention is to provide a dome structure having a tensegrity grid, i.e., a system that uses tension members with isolated compression members, which significantly stiffens the braced dome top ridge portion thereby increasing the stability and allowing the structure to carry significantly greater live loads.

Further still an object of this invention is to provide a dome structure which combines an upper region in compression with a lower region under tension, wherein the lower region may be comprised of cable members, steel members or a combination thereof.

Yet a further object of this invention is to provide a cable-braced dome which provides for the ability to fine tune the tension in the diagonal members to economize the use of steel in the top ridge system thereby making it equally as efficient to carry compressive loads under a downward live load as to carry tension under an upward wind load.

Yet still a further object of this invention is to create a dome system which is easy to construct and allows construction to progress sequentially from the outer perimeter to the center without needing shoring towers.

Another object of this invention is to provide a dome structure whose design allows for the self-resolution of forces, thereby eliminating the need for an outer compression ring.

Finally, an object of this invention is to provide a dome structure which is capable of clear spanning large areas economically and whose design allows for spanning a structure having flat sidewalls.

All these objects and others are achieved by the invention disclosed herein.

These drawings and the descriptions which follow are presented for the purpose of illustration and description only and are not to be construed as limiting the invention in any way. The scope of the invention is to be determined by the claims.

DESCRIPTION OF THE PREFERRED EMBODIMENT

Figure 1:
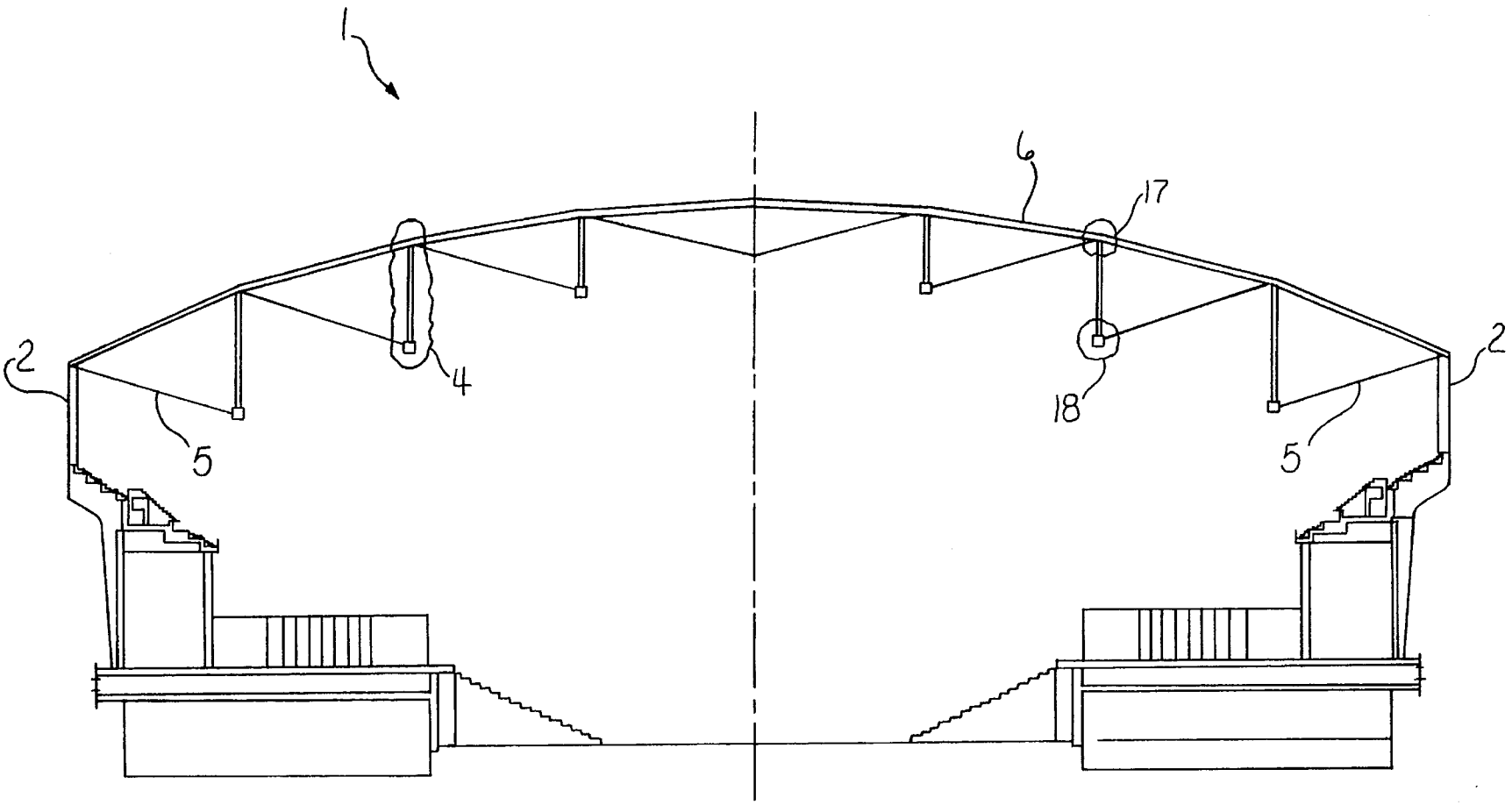
FIG. 1 is a traverse section cut-away view of the dome structure.
Figure 2A:
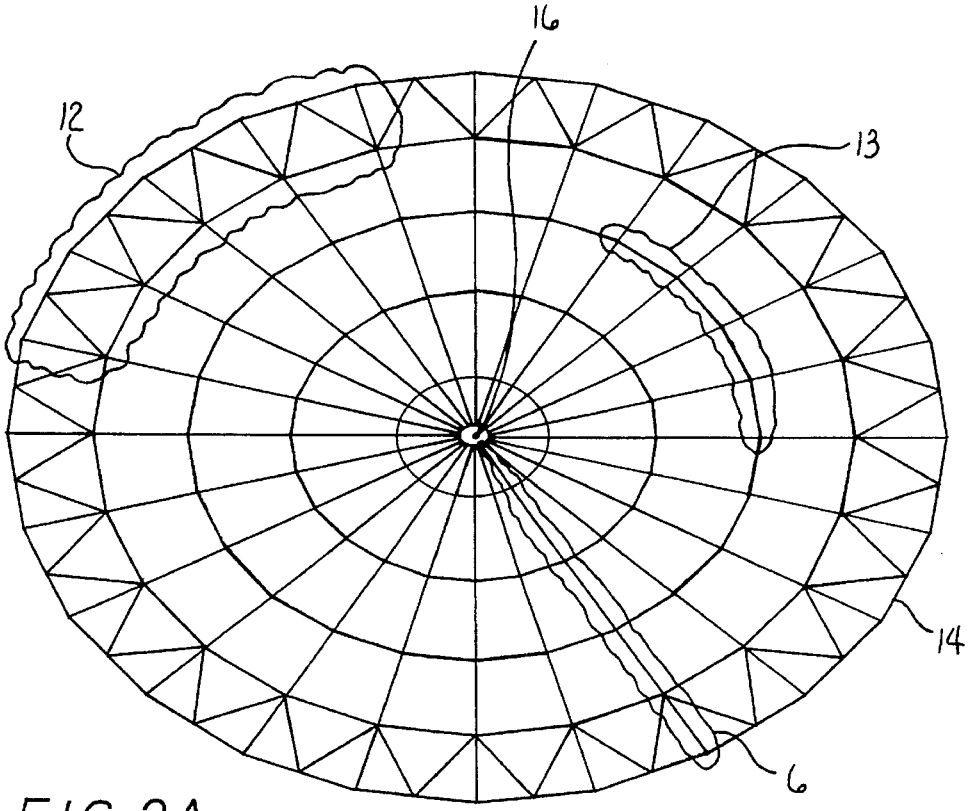
FIG. 2A is a top plan view of the dome structure showing the ridge framing plan of the elliptical plan form embodiment.
Figure 2B:
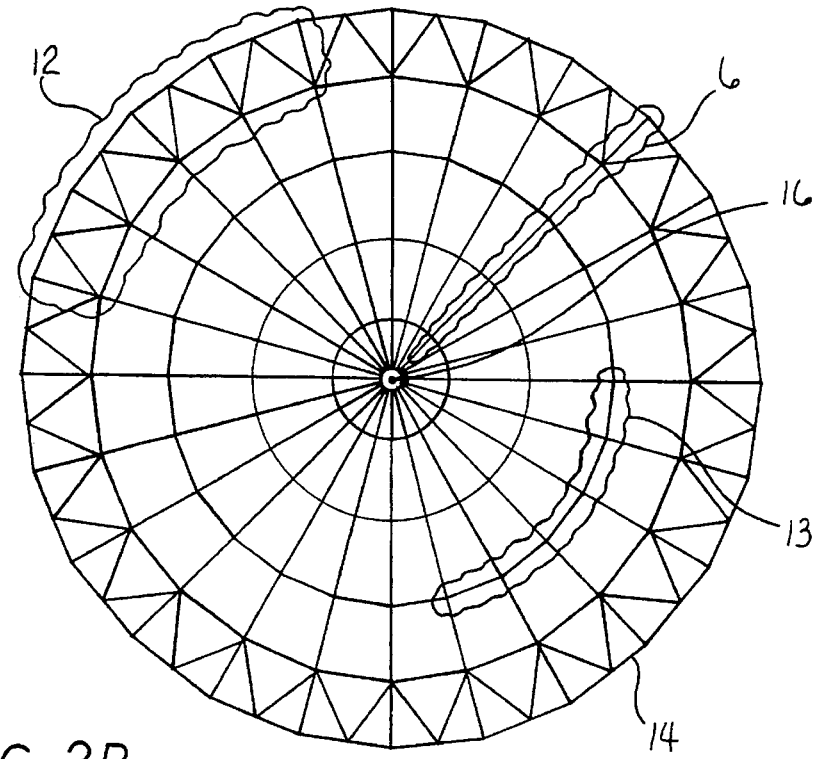
FIG. 2B is a top plan view of the dome showing the ridge framing plan of the circular plan form embodiment.
Figure 7:
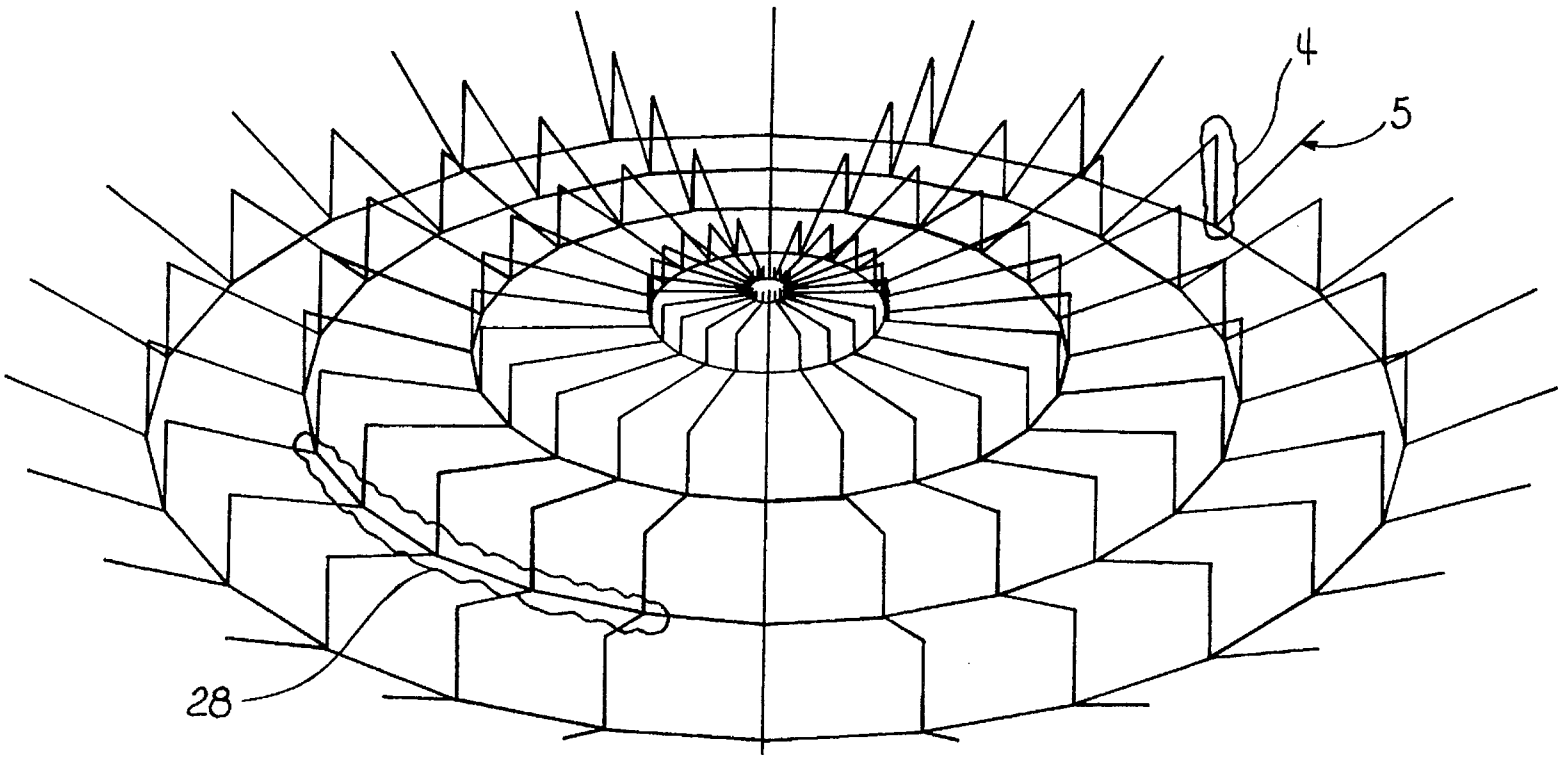
FIG. 7 is an isometric view of the compression members, diagonal members and lower circumferential members for the tensegrity grid of an elliptical plan form.
Figure 8:
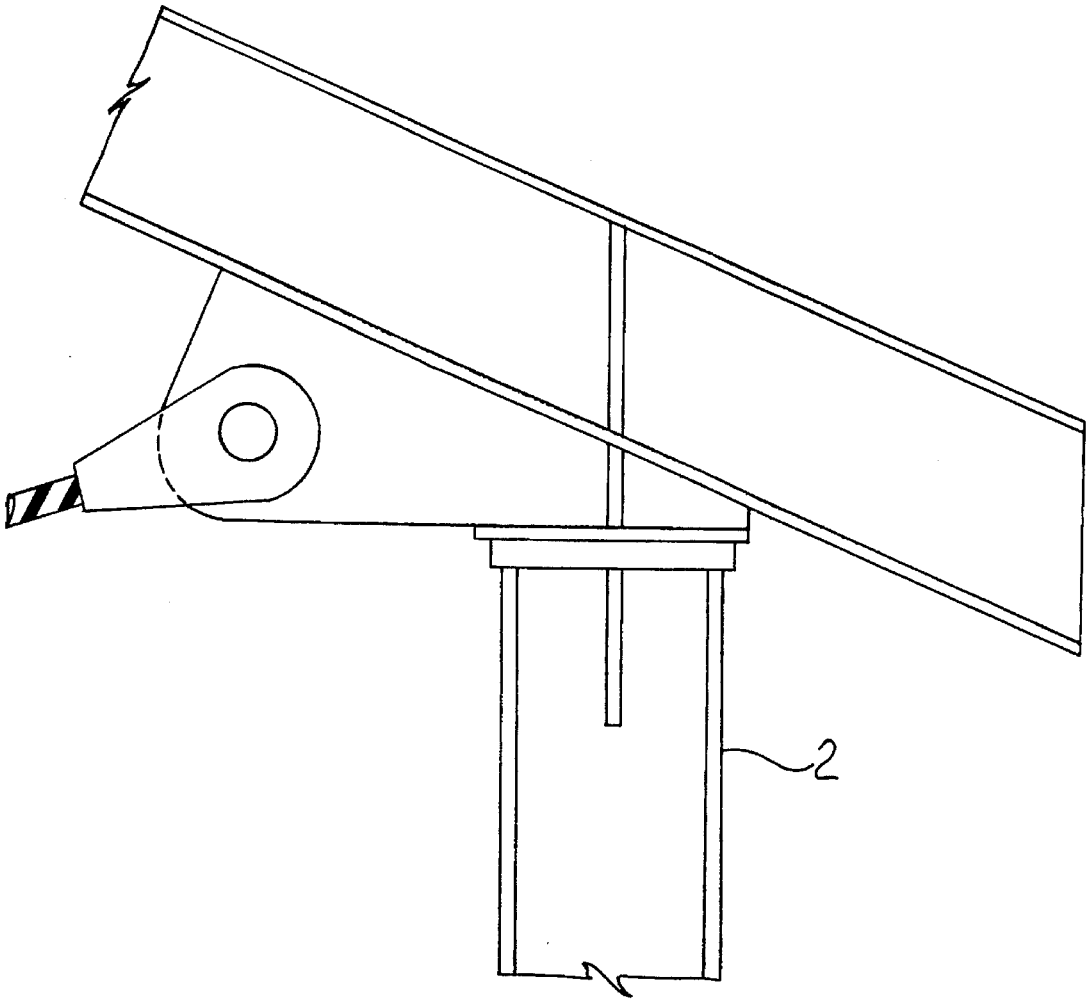
FIG. 8 is a cut-a-way cross-sectional view of the connection of the dome structure to the stadium structure.

As shown in FIGS. 1 and 8, dome 1 attaches directly to stadium structure 2 without the need for an independent concrete compression ring. Thus, the tension braced dome is self-contained and equally adaptable to embodiments having elliptical shaped walls, as shown in FIG. 2A, as it is to embodiments having rounded walls, as shown in FIG. 2B. The tension braced dome is comprised of two main components, top ridge showing in FIG. 6 and tensegrity grid (Shown in FIG. 7. In FIGS. 1 and 8, in the preferred embodiment top ridge 10 is secured directly to stadium wall 2 by a bolted connection or other conventional steel connection (not shown). Tensegrity grid 3 is likewise secured directly to the stadium wall through mounting diagonal member 5 to the stadium wall by a bolted connection or other conventional steel connection (not shown).

A tensegrity grid is distinct from the top ridge having the function of vertical support with a preferred arrangement (shown in FIG. 7) which is an arrangement of tension members, having at least one diagonal member 5, at least one lower circumferential member 28 and at least one compression member 4. The preferred embodiment of the compression member is comprised of mast 19 shown in FIG. 4A and 4B.

Figure 6:
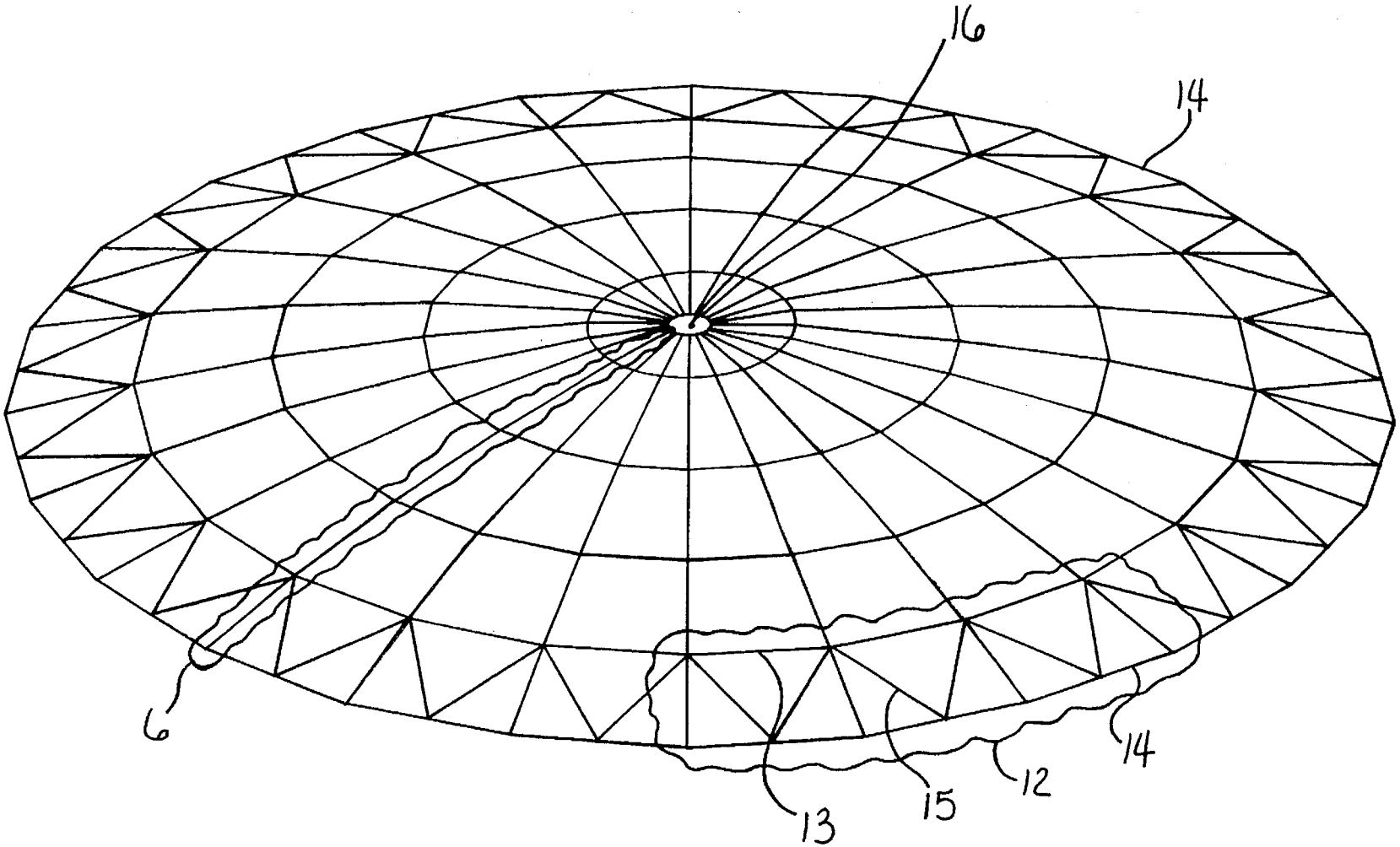
FIG. 6 is an isometric view of the top ridge of an elliptical plan form exposing the upper ridge radial members, the circumferential members and the bay.

As shown in FIGS. 2A, 2B and 6, in the preferred embodiment, the top ridge is comprised of at least one upper ridge radial member 6 and at least one circumferential member 13 and contains a means for resolving internal stresses 12 which is an integral part of the top ridge. The upper ridge radial member extends radially outward from center of origin 16 to edge member 14. The circumferential member is mounted between the upper ridge radial member and extends in the circumferential direction around the center of origin and is concentric with the edge member.

Figure 3:
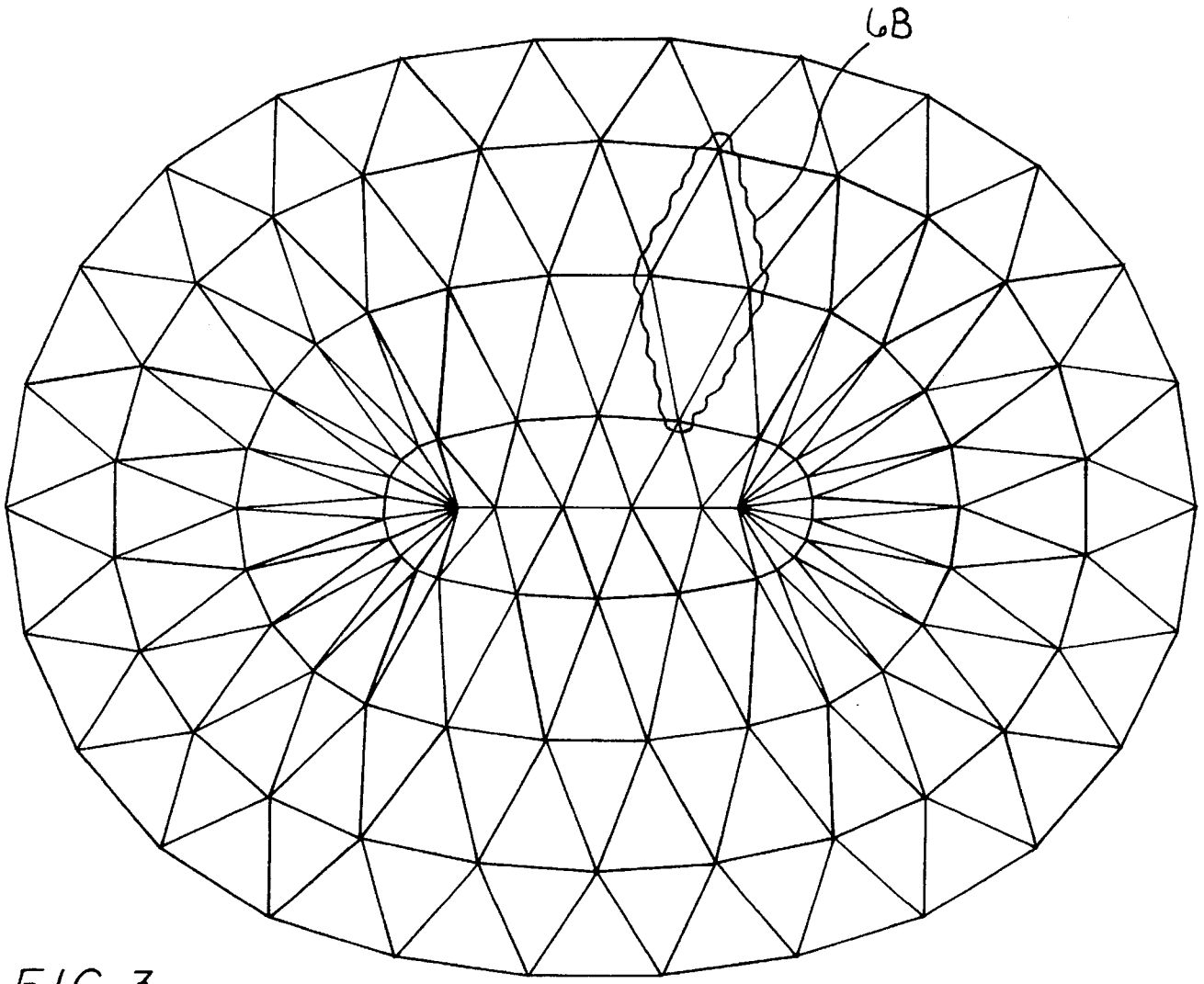
FIG. 3 is a top plan view of an alternate embodiment of the dome structure's top ridge.

In an alternate embodiment, as shown in FIG. 3, the top ridge is comprised of at least one triangulated member 6B. The triangulated members may be used instead of the upper ridge radial members and the circumferential members for architectural reasons or because triangulated members provide better lateral stability thereby eliminating the need for secondary lateral bracing members.

In the preferred embodiment, the upper ridge radial member, triangulated member and the circumferential member are constructed from structural steel shapes, such as steel wide flange shapes or structural pipe or tubing which are capable of carrying compressive or tensile loads.

The circumferential member allows the top ridge to exhibit the structural advantages of a braced dome, thereby allowing the top ridge to carry compressive and tensile loads in the circumferential direction, as well as the radial direction.

In the triangulated configuration, the radial and circumferential forces are resolved into tension and compression in the upper ridge members based upon the geometry of the members.

The top ridge can consist of a variety of geometric configurations, as shown in FIGS. 2A, 2B, 3 and 6, depending upon the aesthetics and loading requirements and provided there exists a mechanism to carry circumferential forces which lends itself to coexisting with the tensegrity grid.

The details of the top ridge configuration can readily be established by those skilled in the art based upon the shape of the building and the desired structural behavior. A computer analysis may be used to determine the configuration based upon shape and loading criteria.

FIG. 2B depicts an alternate embodiment of the top ridge wherein the upper ridge radial member 6 extends outward from center of origin 16, thereby providing for a circular planform.

Figure 4A:
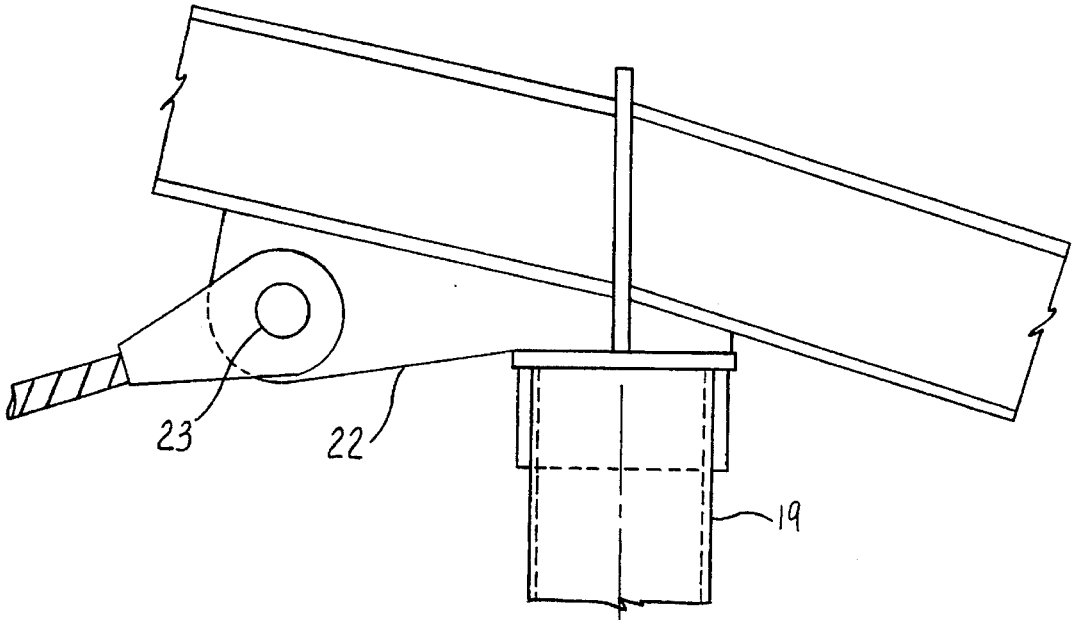
FIG. 4A is a cut away view of the mast top end.
Figure 4B:
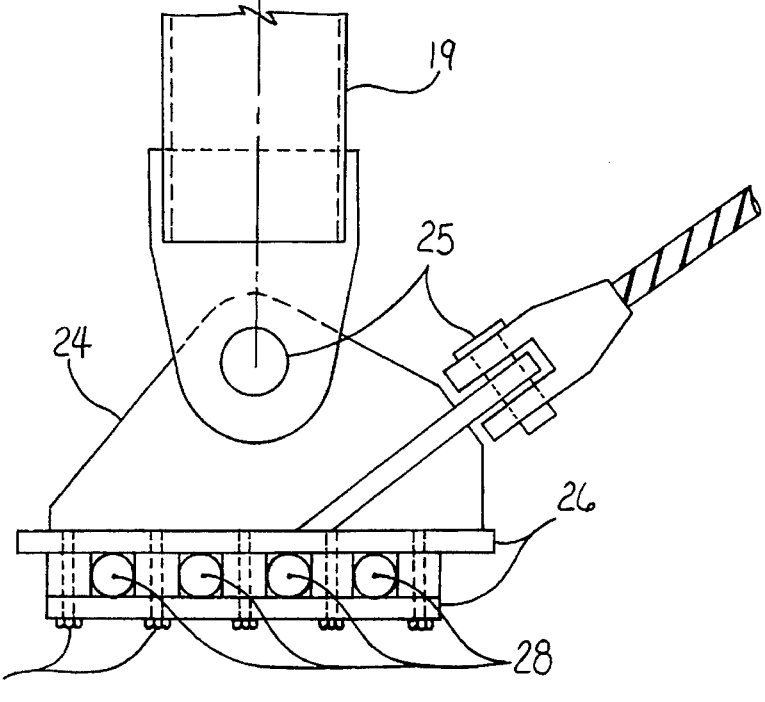
FIG. 4B is a cut away view of the mast lower end.

Mast 19 is the preferred embodiment of the compression member as shown in FIGS. 1, 4A and 4B. The mast is comprised of top end 17 (See FIG. 1) and lower end 18 (See FIG. 1). FIG. 4A depicts the top means for securing as comprising plate 22 and steel pins 23. The upper ridge radial members and the diagonal member are each mounted to the plate by at least one steel pin 23. The preferred top means for securing is comprised of at least one steel pin, however an alternate top means for securing may be comprised of a bolted connection.

As shown in FIG. 4B, mounted to the lower end is lower means for securing lower end 18 (See FIG. 1). FIG. 413 depicts the lower means for securing as comprising plate 24, steel pins 25 and means for connecting lower circumferential member 26. The lower end 18 and diagonal members are each mounted to the plate by at least one steel pin 25. The preferred means for connecting lower circumferential member is comprised of connection plate 26 and clamping bolt 27. The connected plates 26 are secured perpendicularly to plate 24 and the lower circumferential members are secured to the connection plates 26 by clamping bolts 27. FIG. 4B depicts the lower means for securing shown in FIG. 1. The preferred lower means for securing is comprised of at least one steel pin, however an alternate lower means for securing may be comprised of a bolted connection.

The preferred means for resolving internal stresses 12 is bay 21, shown in FIGS. 2A, 2B and 6. The configuration of the means for resolving internal stresses may be determined by one skilled in the art through standard mathematical calculations based upon the lateral forces exerted by the upper ridge radial members and diagonal members.

As shown in FIGS. 2A, 2B and 6, in the preferred embodiment the means for resolving internal stresses is a bay comprising circumferential member 13, edge member 14, upper ridge radial member 6, at least one first diagonal bay member 15. The function of the first diagonal bay member is to create a horizontal truss within the top ridge. The first diagonal bay member extends from an intersection of the upper ridge radial member and the circumferential member to a point on the edge member. The edge member is capable of carrying compressive and tensile loading as is the first diagonal bay member. The bay eliminates the need for a compression ring because of its ability to resolve the horizontal forces within the top ridge. This self-resolution is achieved by truss action developed within the bay. Various geometric configurations can be achieved to exhibit horizontal truss behavior within the surface of the top ridge component thereby constituting alternate embodiments of the means for resolving internal stresses.

The tensegrity grid (shown in FIG. 7) is comprised of diagonal member 5, compression member 4 (the compression member in the preferred embodiment is mast 19) and in the preferred embodiment, lower circumferential member 28. The diagonal member (shown in FIG. 1) is a tension member which extends between upper ridge radial member 6 and the compression member 4 which in the preferred embodiment is a mast 19. In the preferred embodiment the diagonal members and lower circumferential members are cables. In alternate embodiments, the diagonal members and the lower circumferential members can be solid rod, steel pipe or other structural shapes which can support tensile loading.

In addition, the cable based dome structure may include a lower diagonal member (not shown), which spans between the lower end of each mast of the tensegrity grid. These lower diagonal members however are not an integral part of the structure nor are they needed in order to support an elliptical shaped cable braced dome. Lower diagonal members may however be useful for hanging lighting, speakers or other such equipment for use within the dome structure. The lower diagonal members may be solid rod, steel pipe or other structural shapes which can support tensile loading.

In the preferred embodiment the lower circumferential member is mounted to the lower end of each mast in a given plane. FIG. 4B depicts the means for connecting the lower circumferential member to the lower end of the mast.

Figure 9:
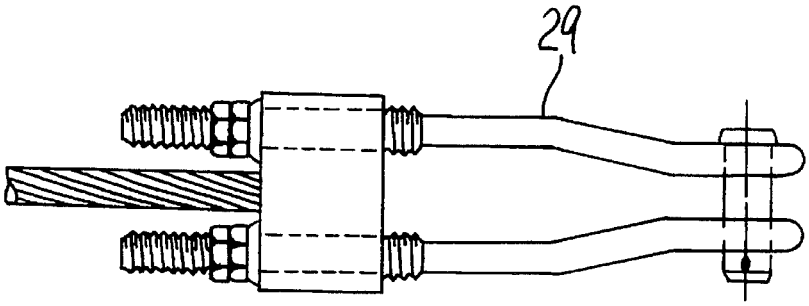

In the preferred embodiment the tension in the diagonal members 5 can be adjusted, by means for adjusting tension 29 (shown in FIG. 9) to optimize the use of steel in the top ridge system thereby making it equally as efficient to carry compressive loads under a downward live load as do carry tension loads under an upward wind load. The preferred means for adjusting tension is adjustable sockets mountably attached to the diagonal member. Alternate embodiments include turnbuckles and other means of adjusting the length of the diagonal member, such as hydraulic connections.

Moreover, the top ridge is thereby significantly stiffened allowing the structure to carry significantly greater live loads without exhibiting instability behavior in a snap-through buckling mode. The present invention is capable of utilizing the advantages of a single layer braced dome and eliminating the danger of instability in a snap-through buckling mode. To avoid the buckling limit of each compression member the lower ridge component can be adjusted to put the system into tension under a deadload rather than compression.

The support of the tension braced dome is independent of the cladding placed over the top ridge. As a result, the tension braced dome lends itself to fabric cladding as well as, steel or composite materials.

I claim:

1. A dome structure comprising:

(a) A top ridge having at least one upper ridge radial member, a center of origin and a edge member, wherein said upper ridge radial member extends radially outward from said center of origin to said edge member, wherein said upper ridge radial member and said edge member intersect; and said upper ridge radial member being capable of carrying compressive and tensile loading;

at least one circumferential member wherein said circumferential member is mountably attached to the upper ridge radial member and extends in the circumferential direction around said center of origin and is concentric with said edge member; wherein said circumferential member is capable of carrying compressive and tensile loading;

the top ridge further comprising a means for resolving internal stresses which is an integral part of said top ridge;

(b) A tensegrity grid distinct from the top ridge and mountably attached thereto, having the function of providing vertical support to said top ridge and being comprised of at least one diagonal member, at least lower circumferential member and at least one compression member; wherein said diagonal member extends between and is mountably attached to the upper ridge radial member and the compression member; wherein said lower circumferential member is mountably attached to the compression member and extends in a circumferential direction in a plane occupied by the tensigrity grid.

2. The dome structure is set forth in claim 1 wherein said upper ridge radial member is comprised of structural steel shapes.

3. The dome structure is set forth in claim 1 wherein said circumferential member is comprised of structural steel shapes.

4. A dome structure comprising:

(a) A top ridge having at least one upper ridge radial member, being comprised of structural steel shapes, a center of origin and a edge member; wherein said upper ridge radial member extends radially outward from said center of origin to said edge member, wherein said upper ridge radial member and said edge member intersect; said upper ridge radial member being capable of carrying compressive and tensile loading; and at least one circumferential member being comprised of structural steel shapes; wherein said circumferential member is mountably attached to the upper ridge radial member and extends in the circumferential direction around said center of origin and is concentric with said edge member; said circumferential member being capable of carrying compressive and tensile loading; and the top ridge also having as an integral part of said top ridge a bay comprised of a first diagonal bay member which extends from an intersection of the upper ridge radial member and the circumferential member to a point on the edge member; wherein said edge member is capable of carrying compressive and tensile loading; and wherein said first diagonal bay member is capable of carrying compressive and tensile load;

(b) a tensegrity grid distinct from the top ridge having the function of providing vertical support to said top ridge and being comprised of at least one diagonal member, at least lower circumferential member and at least one mast;

said mast being comprised of a top end and a lower end, wherein mounted to said top end is a top means for securing and mounted to said lower end is a lower means for securing;

wherein said diagonal member extends between and is mountably attached to the upper ridge radial member and the compression member at the top ridge; wherein said lower circumferential member is mountably attached to the compression member and extends in a circumferential direction in a plane occupied by the tensegrity grid.

5. The dome structure as set forth in claim 4 in said top means for securing is comprised of a plate and at least one steel pin.

6. The dome structure as set forth in claim 4 wherein said top means for securing is a bolted connection.

7. The dome structure as set forth in claim 4 wherein said lower means for securing is comprised of a plate and at least one steel pin and is further comprised of at least one plate and at least one steel pin securing the lower circumferential member to the plate.

8. The dome structure as set forth in claim 4 wherein said lower means for securing is a bolted connection.

9. The dome structure set forth in claim 4 having a means for adjusting tension in the diagonal member.

10. The dome structure set forth in claim 9 wherein said means for adjusting the tension in the diagonal member is at least one adjustable socket mountably attached to said diagonal member.

11. The dome structure as set forth in claim 9 wherein said means for adjusting the tension in the diagonal member is at least one turnbuckle.

12. The dome structure as set forth in claim 4 further comprised of a lower diagonal member spanning between two compression members.

13. A dome structure comprising:

(a) A top ridge having at least one upper ridge triangulated member, being comprised of structural steel shapes, a center of origin and a edge member; wherein said upper ridge triangulated member extends at an angle to a radius outward from saind center of origin to said edge member; said upper ridge triangulated member being capable of carrying compressive and tensile loading; and at least one circumferential member being comprised of structural steel shapes; wherein said circumferential member is mountably attached to the upper ridge triangulated member and extends in the circumferential direction around said center of origin and is concentric with said edge member; said circumferential member being capable of carrying compressive and tensile loading; and the top ridge also having as an integral part of said top ridge a bay comprised of a first diagonal bay member which extends from an intersection of the upper ridge triangulated member and the circumferential member to a point on the edge member; wherein said edge member is capable of carrying compressive and tensile loading; and wherein said first diagonal bay member is capable of carrying compressive and tensile load;

(b) a tensegrity grid distinct from the top ridge having the function of providing vertical support to said top ridge and being comprised of at least one diagonal member, at least lower circumferential member and at least one mast; said mast being comprised of a top end and a lower end, wherein mounted to said top end is a top means for securing and mounted to said lower end is a lower means for securing;

wherein said diagonal member extends between and is mountably attached to the upper ridge triangulated member and the compression member at the top ridge; wherein said lower circumferential member is mountably attached to the compression member and extends in a circumferential direction in a plane occupied by the tensegrity grid.

* * * * *